United States Patent [19]

Engh

[11] Patent Number: 4,534,581

[45] Date of Patent: Aug. 13, 1985

[54] PRODUCT AND METHOD FOR USING AIRLINE TICKETS

[75] Inventor: Gordon L. Engh, Mission Viejo, Calif.

[73] Assignee: Nekoosa Envelopes, Inc., Englewood, Colo.

[21] Appl. No.: 561,474

[22] Filed: Dec. 14, 1983

[51] Int. Cl.[3] ..... B42D 1/00

[52] U.S. Cl. ..... 281/15 R; 229/68 R; 229/72; 281/5; 283/63 R

[58] Field of Search ..... 229/68 R, 72; 281/2, 281/3 R, 5, 15 R; 283/61, 62, 63

[56] References Cited

U.S. PATENT DOCUMENTS

| | | | |
|---|---|---|---|
| 715,162 | 12/1902 | Schwartz | 281/2 X |
| 3,159,329 | 12/1964 | Hiersteiner | 229/68 R |
| 3,229,893 | 1/1966 | Stein | 229/68 R |
| 3,347,449 | 10/1967 | Behal | 229/68 R |
| 3,655,119 | 4/1972 | Thompson | 229/72 |
| 3,734,396 | 5/1973 | Cowan | 229/68 |
| 3,788,540 | 1/1974 | Sammons | 229/72 |
| 3,847,195 | 11/1974 | Tyrseck | 150/39 |
| 4,011,985 | 3/1977 | Simson | 229/68 R |
| 4,042,171 | 8/1977 | Ross et al. | 229/72 |
| 4,051,996 | 10/1977 | Ross et al. | 229/72 |
| 4,452,399 | 6/1984 | Schoenleber et al. | 229/72 |

OTHER PUBLICATIONS

Citicorp Diners Club Airline Ticket Holder.
AirCal Ticket Holder.

*Primary Examiner*—Paul A. Bell
*Attorney, Agent, or Firm*—Sheridan, Ross & McIntosh

[57] ABSTRACT

An airline ticket holder is provided with a first ticket holder attached to one panel of a common page and a second ticket holder attached to a second panel of the common page. The common page contains an order form and prepaid addressed post card which may be separated from the common page and deposited in the mail.

10 Claims, 5 Drawing Figures

PRODUCT AND METHOD FOR USING AIRLINE TICKETS

FIELD OF THE INVENTION

This invention relates to a product and method for use with airline tickets and more specifically to multiple holders for airline tickets associated with promotional material.

BACKGROUND OF THE INVENTION

For many years, airline ticket holders have been formed from three panels. Two of the panels are folded around a common fold line and secured along a bottom edge to form a pocket for the airline ticket. The folded together panels have a common fold line with the third panel so that when folded around this common fold line a two page ticket holder is formed. Additions to the basic airline ticket holder are disclosed in U.S. Pat. Nos. 3,655,119; 3,734,396; 3,788,540; 4,042,171 and 4,051,171 but these patents retained the basic two page characteristic. U.S. Pat. No. 3,847,195 discloses the making of a wallet out of cardboard wherein the wallet comprises three pages connected along a common hinge line wherein each of the pages is provided with a pocket for holding slips of paper.

BRIEF DESCRIPTION OF THE INVENTION

This invention provides an airline ticket holder comprising multiple airline ticket holders associated with promotional material. The airline ticket holder comprises a common page; a first ticket holder secured to one portion of the common page and a second ticket holder secured to another portion of the common page. In the preferred embodiment, the common page comprises two panels having portions thereof secured together. One panel of the common page contains advertising and an order form which may be completed by the ticket holder. The second panel of the common page contains an addressed and stamped card so that the order form can be mailed. Suitable perforations are provided so that the card and order form may be readily separated from the common page.

It is an object of this invention to provide multiple airline ticket holders separately secured to a common page.

It is another object of this invention to provide means so that one of the airline ticket holders may be readily detached from the common page.

It is a further object of this invention to provide the common page with an order form that may be readily separated from the common page and deposited in the mail.

Other features and advantages of the invention will be apparent from the following more particular description of preferred embodiments as illustrated in the accompanying drawings in which like reference characters refer to the same parts throughout the various views. The drawings are not necessarily to scale, emphasis instead being placed upon illustrating the principles of the invention.

DETAILED DESCRIPTION OF THE INVENTION

Figure 1:
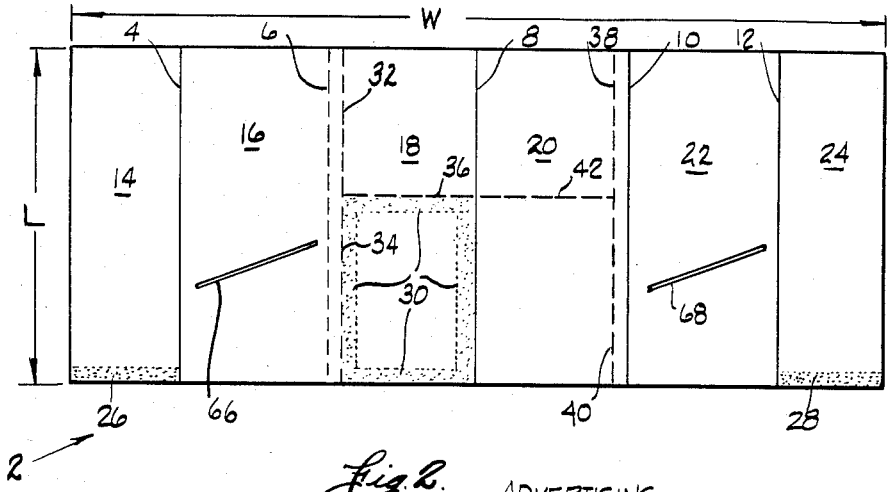
FIG. 1 is a plan view of one side of the blank of this invention.

In the preferred embodiment of the invention as illustrated in the drawings, there is disclosed in FIG. 1 one side of a blank 2 comprising a rectangular sheet of paper having a length L and a width W. The blank 2 is provided with a plurality of fold lines 4, 6, 8, 10 and 12 to divide the blank 2 into a plurality of panels 14, 16, 18, 20, 22 and 24. Panels 14 and 24 are provided with adhesive 26 and 28 along one edge thereof. Panel 18 is provided with a rectangularly shaped area of adhesive 30. Panel 18 is also provided with perforated lines 32, 34 and 36. Panel 20 is provided with perforated lines 38, 40 and 42. Fold line 6 is also perforated.

Figure 2:
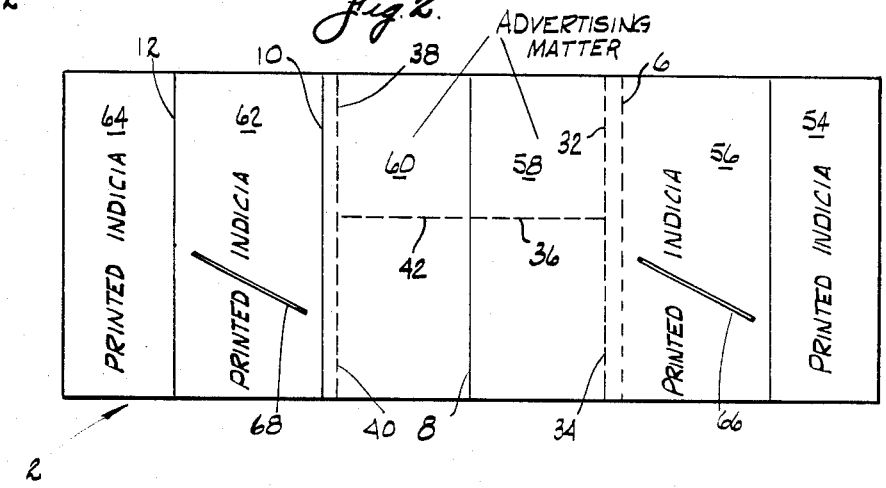
FIG. 2 is a plan view of the other side of the blank of this invention.

The other side of the blank 2 is illustrated in FIG. 2 and has the same fold lines 4, 6, 8, 10 and 12 to divide the blank 2 into a plurality of panels 54, 56, 58, 60, 62 and 64. For sake of clarity, the one side of the panels and the other side of the panels are identified so that the last digit of each panel is the same. Panel 16 and 56 is provided with a slot 66 and panel 22 and 62 is provided with a slot 68. Panels 54, 56, 62 and 64 are provided with printed indicia relative to airline information. Panels 58 and 60 are provided with advertising matter.

Figure 3:
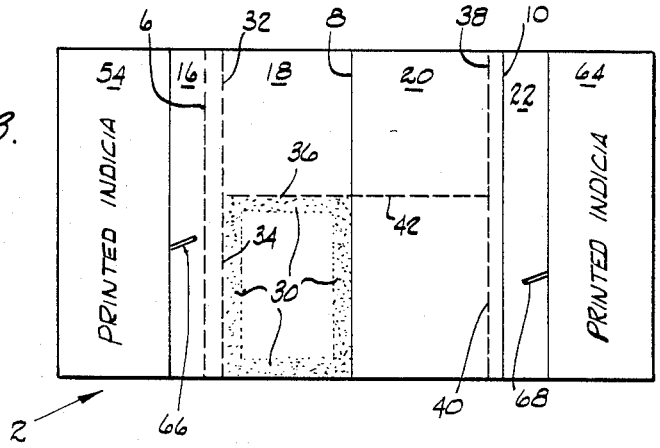
FIG. 3 is a plan view after the first folding of the blank of this invention.

FIG. 3 illustrates the blank 2 after the first folds have been made. Panel 14 has been folded around fold line 4 so that panels 14 and 16 are in facing relationship. Adhesive 26 is activated so that panels 14 and 16 are secured together at that location so as to form a pocket between them. Panel 24 has been folded around fold line 12 so that panels 24 and 22 are in facing relationship. Adhesive 28 is activated so that panels 24 and 22 are secured together at that location so as to form a pocket between them.

Figure 4:
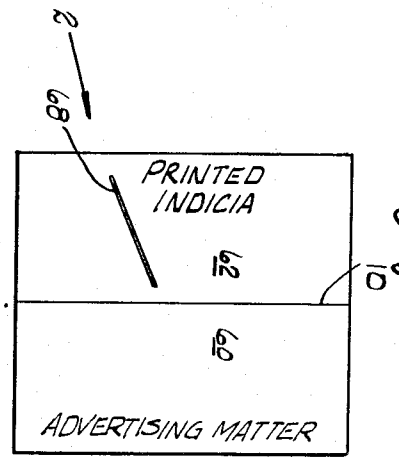
FIG. 4 is a plan view after the second folding of the blank of this invention.

FIG. 4 illustrates the blank 2 after the second fold has been made. Panels 20, 22 and 64 have been folded around fold line 8 so that panels 18 and 20 are in facing relationship and panel 54 and portions of panel 16 are in facing relationship with panel 64 and portions of panel 22. The adhesive 30 is activated so that panels 18 and 20 are secured together at that location.

Figure 5:
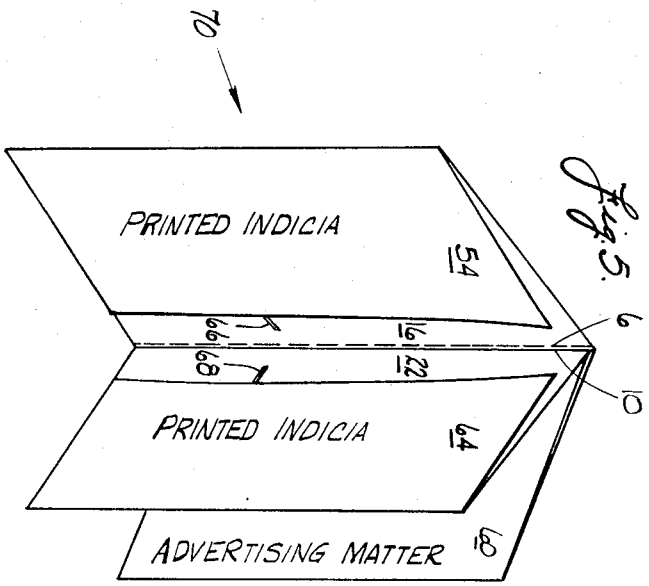
FIG. 5 is a pictorial view of the completely folded blank of this invention.

FIG. 5 illustrates the blank 2 after the final folds have been made. Panels 62 and 64 have been folded around fold line 10 so that panels 62 and 60 are in facing relationship. Panels 54 and 56 have been folded around fold line 6 so that panels 54 and 64 are in facing relationship. The airline ticket holder 70 is now ready for use.

In operation, the travel agency prepares a unit comprising at least a first ticket, a second ticket and a record of the first and second tickets. The unit is placed within the pocket between panels 14 and 16 and the airline ticket holder is given to the passenger. At the airport, the ticket agent removes the unit from between panels 14 and 16 and examines the first ticket so as to assign a seat on the proper plane for the passenger. The agent removes the first ticket and returns the remaining portion of the unit, comprising the second ticket and the record, into the pocket between the panels 14 and 16. The airline ticket holder 70 is folded so that panel 56 is on the outside. A boarding pass indicating the seat, flight and gate numbers is inserted through the slot 66 and the airline ticket holder 70 is returned to the passenger. The seat, flight and gate number are also written on the face of panel 56. After the passenger departs from the plane, the remaining portion of the unit is removed from the pocket between panels 14 and 16 and inserted into the pocket between panels 22 and 24. Panels 14, 54, 16 and 56 are severed along the perforated fold line 6 and discarded. The panels 64 and 22 are folded around fold line 10 so that panels 64 and 22 are in facing relationship with panel 58. If the passenger does not remove the remaining portion after departing from the plane, this sequence is done by the ticket agent when the ticket holder is presented for the second flight.

In the foregoing paragraph, the first and second tickets represent an outgoing and a return flight. If more than two tickets are in the unit, the ticket agent will supply an additional ticket holder at the appropriate time.

In another mode of operation, the ticket agent instead of inserting the remaining portion of the unit into the pocket between panels 14 and 16 can insert the remaining portion of the unit into the pocket between the panels 22 and 24. After departing from the plane, the passenger severs panels 14, 54, 16 and 56 along perforated line 6 and folds panels 64 and 22 around fold line 10 so that panels 64 and 22 are in facing relationship with panel 58.

At some time, the passenger will read the advertising matter on panel 60 which also contains an order form. If interested, the passenger completes the order form and separates it from the panels 58 and 60 by tearing along superposed perforated lines 36–42 and 34–40. The separated portion of panel 50 contains a prepaid and addressed form so that the passenger can deposit the separated form directly in the mail since the secured together portions of panels 58 and 60 have sufficient stability to meet postal requirements.

In previous practice, when the passenger appeared at the airport for use of the second ticket, the ticket agent would remove the remaining portion of the unit and discard the first airline ticket holder. A second airline ticket holder would then be used to provide the boarding pass and seat, flight and gate numbers and the last portion of the unit, comprising the record of the first and second tickets inserted into the pocket. In this practice, no use was made of the third panels of the first and second airline ticket holders. The invention in this application provides a use for these third panels. Also, the use of the multiple ticket holder results in substantial savings since the multiple ticket holder can be made in one operation so that time, labor and operating costs are substantially the same in the manufacture of a single or multiple ticket holder.

While the preferred embodiments of the invention have been illustrated and described herein, it may be otherwise embodied and practiced within the scope of the following claims.

What is claimed is:

1. A ticket holder comprising:

a common page comprising first and second panels secured together and having a first fold line;

each of said first and second panels having a length and a width with said length being greater than said width;

said first fold line extending in a lengthwise direction;

a first ticket holder comprising third and fourth panels and joined to said first panel along a second fold line;

said third panel having a length and a width, each corresponding to said length and width of said first and second panels;

said fourth panel having a length approximately the same as the length of said third panel and a width less than the width of said third panel;

said third panel being joined to said first panel along said second fold line which fold line extends in a lengthwise direction;

said fourth panel being joined to said third panel along a third fold line extending in a lengthwise direction;

means securing said third and fourth panels along one widthwise edge so as to form a pocket between said third and fourth panels;

a second ticket holder comprising fifth and sixth panels and joined to said second panel along a fourth fold line;

said fifth panel having a length and a width, each corresponding to said length and width of said first and second panels;

said sixth panel having a length approximately the same as the length of said fifth panel and a width less than the width of said fifth panel;

said fifth panel being joined to said second panel along a said fourth fold line which fold line extends in a lengthwise direction;

said sixth panel being joined to said fifth panel along a fifth fold line extending in a lengthwise direction;

means securing said fifth and sixth panels along one widthwise edge so as to form a pocket between said fifth and sixth panels; and each of said fold lines being independent.

2. A ticket holder as in claim 1 and further comprising:

a slot in said third panel extending generally in a widthwise direction and being of a sufficient length so that a boarding pass may be inserted therethrough; and a slot in said fifth panel extending generally in a widthwise direction and being of a sufficient length so that a boarding pass may be inserted therethrough.

3. A ticket holder as in claim 2 and further comprising:

a score line common with said fold line between said said second fold line being perforated.

4. A ticket holder as in claim 3 further comprising:

a perforated line in said first panel extending adjacent to and parallel to said second fold line.

5. A ticket holder as in claim 4 further comprising:

a perforated line in said second panel extending in a lengthwise direction and being superposed over said score line in said first panel when said first and second panels form said common page.

6. A ticket holder as in claim 5 and further comprising:

another pair of superposed perforated lines in said first and second panels extending in a widthwise direction and intersecting with said superposed perforated lines in said first and second panels; and means on one of said first or second panel so that when a section of said common page is separated by tearing along said superposed perforated lines of said first and second panels said section may be mailed to a predetermined address.

7. A ticket holder as in claim 6 wherein said section comprises:

superposed portions of said first and second panels which portions have been adhesively secured to each other.

8. A ticket holder as in claim 7 folded along said second and fourth fold lines comprising:

a first page comprising said third and fourth panels and wherein said third panel comprises an outer panel and said fourth panel comprises an inner panel;

a second page comprising said fifth and sixth panels and wherein said sixth panel is in confronting relationship with said fourth panel; and a third page comprising said common page formed from said first and second panels and wherein said second panel is in confronting relationship with said fifth panel.

9. A blank for use in forming a ticket holder comprising:

a rectangular sheet having a predetermined length and width; and a plurality of spaced apart parallel fold lines extending in a lengthwise direction so as to divide said rectangular sheet into a plurality of adjacent panels; wherein a first plurality of said panels have substantially the same width;

a second plurality of said panels having substantially the same width but which width is less than said width of said first plurality of panels;

said rectangular sheet having a first side and a second side so that each of said panels has a first side and a second side;

adhesive on a plurality of said panels;

printed indicia on a plurality of said panels; and wherein said adhesive is located so that when said rectangular sheet is folded about said fold lines a unitary member is formed wherein said unitary member comprises:

a common page comprising a first and a second panel having portions thereof adhesively secured together and wherein one of said fold lines exists betwen said first and second panels;

a first page comprising a third and a fourth panel having portions thereof adhesively secured together and wherein one of said fold lines exists between said third panel and said first panel;

a second page comprising a fifth and a sixth panel having portions thereof adhesively secured together and wherein one of said fold lines exists between said fifth panel and said second panel; and each one of said fold lines being independent.

10. A blank as in claim 9 and further comprising:

a plurality of perforated lines in said blank so that said first page may be removed from said common page; and a section may be removed from said common page.

* * * * *

UNITED STATES PATENT AND TRADEMARK OFFICE

CERTIFICATE OF CORRECTION

PATENT NO. : 4,534,581

DATED : August 13, 1985

INVENTOR(S) : Gordon L. Engh

It is certified that error appears in the above—identified patent and that said Letters Patent is hereby corrected as shown below:

At column 4, claim 3, delete line 46.

At column 6, line 16, delete "betwen" and substitute therefor -- between --.

Column 4, in claim 5, at line 54, delete "score" and substitute therefor -- perforated --.

Signed and Sealed this

Tenth Day of December 1985

[SEAL]

*Attest:*

DONALD J. QUIGG

*Attesting Officer*

*Commissioner of Patents and Trademarks*